US006964583B2

(12) United States Patent
D'Ambrosia et al.

(10) Patent No.: US 6,964,583 B2
(45) Date of Patent: Nov. 15, 2005

(54) CONNECTOR HAVING LOW FREQUENCY NOISE REDUCING GROUND

(75) Inventors: John Francis D'Ambrosia, Harrisburg, PA (US); Steven J. Millard, Mechanicsburg, PA (US); Michael Warren Fogg, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/779,241

(22) Filed: Feb. 13, 2004

(65) Prior Publication Data

US 2005/0181673 A1 Aug. 18, 2005

(51) Int. Cl.[7] ..... H01R 13/648
(52) U.S. Cl. ..... 439/608; 257/207
(58) Field of Search ..... 439/608, 55, 65–69, 439/85; 257/207, 211, 690–692; 438/28–29

(56) References Cited

U.S. PATENT DOCUMENTS 4,616,893 A 10/1986 Feldman ..... 339/14 R
4,762,500 A 8/1988 Dola et al. ..... 439/79
5,046,960 A 9/1991 Fedder ..... 439/108
6,139,364 A * 10/2000 Beutler et al. ..... 439/607
6,267,604 B1 * 7/2001 Mickievicz et al. ..... 439/79
6,344,667 B1 * 2/2002 Miyagi ..... 257/207
6,652,318 B1 * 11/2003 Winings et al. ..... 439/608
6,808,399 B2 * 10/2004 Rothermel et al. ..... 439/108
6,817,898 B2 * 11/2004 Tanaka et al. ..... 439/579

* cited by examiner

*Primary Examiner*—Michael C. Zarroli

(57) ABSTRACT

A high speed signal connector having a plurality of signal conductors disposed within the housing and a ground bus or plane disposed within the housing and including a plurality of coextensive layers of different conductive materials including at least a first conductive base layer having predetermined conductivity and permeability and a second conductive top layer have predetermined conductivity and permeability. A multiple layer common ground provides for improved current flow within the common ground so as to minimize cross talk between signal contacts. As a result, the present invention provides a connector for high frequency signal transmission which exhibits an attenuation characteristic which is substantially independent of frequency within a predetermined and selectable frequency range and which permits the tailoring of the attenuation and phase response of the connector as a function of frequency.

23 Claims, 5 Drawing Sheets

CONNECTOR HAVING LOW FREQUENCY NOISE REDUCING GROUND

FIELD OF THE INVENTION

This invention generally relates to electrical connectors. More particularly, the present invention relates to a connector having improved noise reduction characteristics with respect to signal attenuation caused by "skin effect".

BACKGROUND OF THE INVENTION

Due to the phenomenon known as "skin effect", at high frequencies the electromagnetic fields and current distribution through a conductor is not uniform. For example, in the case of a flat plane conductor, to which is applied waves of increasing frequency, at zero and sufficiently low frequencies, the electromagnetic field and current distribution are substantially uniformly distributed throughout the conductor, and the effective resistance of the conductor is at a minimum. With increasing frequency, the electromagnetic fields and current amplitudes decrease exponentially with increasing depth into the conductor. The current density distribution in the conductor is given by the expression:

$$J = J_O e^{\frac{-x}{\delta}}$$

In this case $J_0$ is the current density at the surface of the conductor, x is the depth of penetration into the conductor, and δ is one skin depth or one skin thickness, which is given by the following expression:

$$\delta = \frac{1}{\sqrt{\pi\mu\sigma f}}$$

where δ is expressed in meters, f is the frequency of the electromagnetic wave in cycles per second, $\mu$ is the permeability of the conductor in henries per meter, and σ is the conductivity of the conductor in mhos per meter.

The factor δ measures the distance in which the current and field penetrating into a metal many times δ in thickness will decrease by one neper, i.e. their amplitude will become equal to 1/e=0.36788 . . . times their amplitude at the conductor surface. The total current carried by the conductor may be accurately calculated as a uniform current, equal in amplitude to the value at the surface that penetrates the conductor only to the depth δ.

In practical applications, the impact of the skin effect appears when the skin depth is less than the physical dimensions of the conductor. Since the skin depth is a function of the signal frequency, the range of conductor dimensions over which the skin effect is of interest also depends on the signal frequency. At audio frequencies, there may be little effect, while at radio or microwave frequencies the skin effect may be the dominant factor.

In signal transmission systems and components thereof, at common transmission rates, the skin effect causes some signal distortion due to the variation of both signal attenuation and the relative phase of the signal as compared to frequency. This, of course, limits the useful length of transmission lines in these applications. The loss of signal amplitude, if too severe, may require the use of an amplifier which adds cost, bulk and complexity to the communication system. The frequency dependency of the attenuation characteristics of high frequency signal interconnects is extremely disadvantageous because it makes the equalization of the line on a periodic basis a complex and expensive procedure. In this regard, the equalizers must exhibit a complementary frequency dependent attenuation characteristic which is a function of the physical and electrical properties of the transmission line(s) for a predetermined signal path.

Similar limitations exist for known connectors. The skin effect may cause signal distortion due to the variation of both signal attenuation and the relative phase of the signal as compared to frequency. There is growing importance of skin effect limitations as the size of connectors decreases.

The foregoing illustrates limitations known to exist in present connectors. Thus, it is apparent that it would be advantageous to provide a connector having improved signal transmission characteristics directed to overcoming one or more of the limitations set forth above. Accordingly, a suitable alternative is provided including features more fully disclosed hereinafter.

SUMMARY OF THE INVENTION

The present invention advances the art of connectors for high frequency signal transmission, and the techniques for creating such a connector. In one embodiment of the present invention, a multiple layer ground trace or signal return is provided having improved high frequency signal transmission characteristics. In another embodiment, a multiple layer ground bus is provided within a connector housing.

In these embodiments, the multi-layer trace or ground bus includes a conductive base layer and a conductive top layer disposed upon the conductive base layer. The relationship between the ratio of permeability to conductivity of the conductive base layer to that of the conductive top layer is given by the following expression:

$$\frac{\mu_2}{\sigma_2} >> \frac{\mu_1}{\sigma_1}$$

Subscript (1) throughout this disclosure refers to the conductive top layer and subscript (2) refers to the conductive base layer. The attenuation of a high frequency signal propagating through the multi-layer trace is substantially independent of frequency within a predetermined frequency range of said signal. The conductive base layer may be comprised of a material selected from a group consisting of, but not limited to, iron, nickel, alloys containing iron, and alloys containing nickel. The conductive top layer may be comprised of a material selected from a group consisting of, but not limited to, silver, copper, gold, aluminum and tin.

The present invention, in another embodiment, provides for improved attenuation and cross talk reduction between signal conductors in a connector. A multiple layer common ground provides for improved current flow within the common ground so as to minimize cross talk between signal contacts. Importantly, current flow within the common ground is preferably confined within predetermined regions of the common ground.

The attenuation of a high frequency signal propagating through the composite conductor of such a construction is substantially independent of frequency within a predetermined frequency range of said signal.

It is, therefore, a purpose of the present invention to provide a connector for high frequency signal transmission which exhibits an attenuation characteristic which is substantially independent of frequency within a predetermined and selectable frequency range.

It is another purpose of the present invention to provide such a conductor for high frequency signal transmission which reduces non-linear signal phase response, with respect to frequency, of the connector.

It is another purpose of the present invention to provide such a connector for high frequency signal transmission which permits the tailoring of the attenuation and phase response of the connector as a function of frequency.

It is yet another purpose of the present invention to provide such a connector which effectively reduces high frequency signal attenuation.

The foregoing and other aspects will become apparent from the following detailed description of the invention when considered in conjunction with the accompanying drawing figures.

DETAILED DESCRIPTION OF THE INVENTION

Quantification of the skin depth of a conductor is particularly significant in determining the attenuation of a predetermined electrical signal through a transmission line, or other suitable, electrically conductive, signal transmission element. The exponential solution for electromagnetic fields and current provides a simplified representation of the current distribution in which the total current in the conductor is limited to a layer of thickness equal to the skin depth. In the case of a solid conductor, the effective limitation of current with respect to one skin depth establishes an effective surface resistance, per unit width and unit length of the conductor, which is given by the expression:

$$R_S = \frac{1}{\sigma\delta}$$

The attenuation, per unit length, of a transmission line due to this surface resistance is given by the expression:

$$\alpha = \frac{R_S}{2wZ_0}$$

where w is the width of the surface of the conductor and $Z_0$ is the characteristic impedance of the transmission line. In such instances when the exponential approximations are valid, the internal inductance of the conductor, per unit width and unit length, is given by the expression:

$$L_i = \frac{R_S}{2\pi f}$$

The frequency dependence of this internal inductance causes a phase shift of a signal at one frequency compared to signals at other frequencies.

A reduction in the surface resistance per unit length of the conductor will cause an improvement in the signal transmission quality and increase the maximum usable length of a transmission line.

Importantly, if the thickness of the conductive top layer is properly determined relative to the skin depth of the conductive top layer, the attenuation of a signal propagating through such a top layer will be substantially independent of frequency.

The important aspect of the present invention is that a multiple layer ground trace or signal return can be achieved, wherein the attenuation of a signal propagating through the ground trace is substantially independent of the frequency of the propagating signal, with such a ground being defined by a conductive base layer and a conductive top layer.

Figure 1:
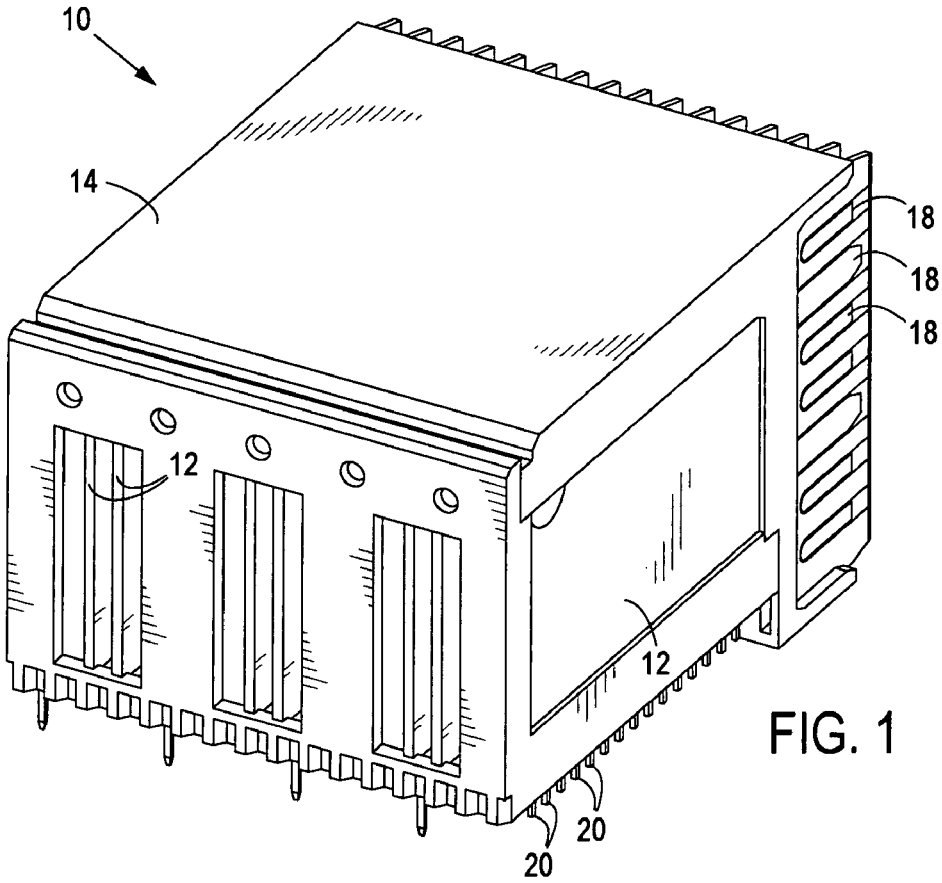
FIG. 1 is an illustration of one embodiment of a connector according to the present invention having a plurality of daughtercards within a housing.
Figure 2:
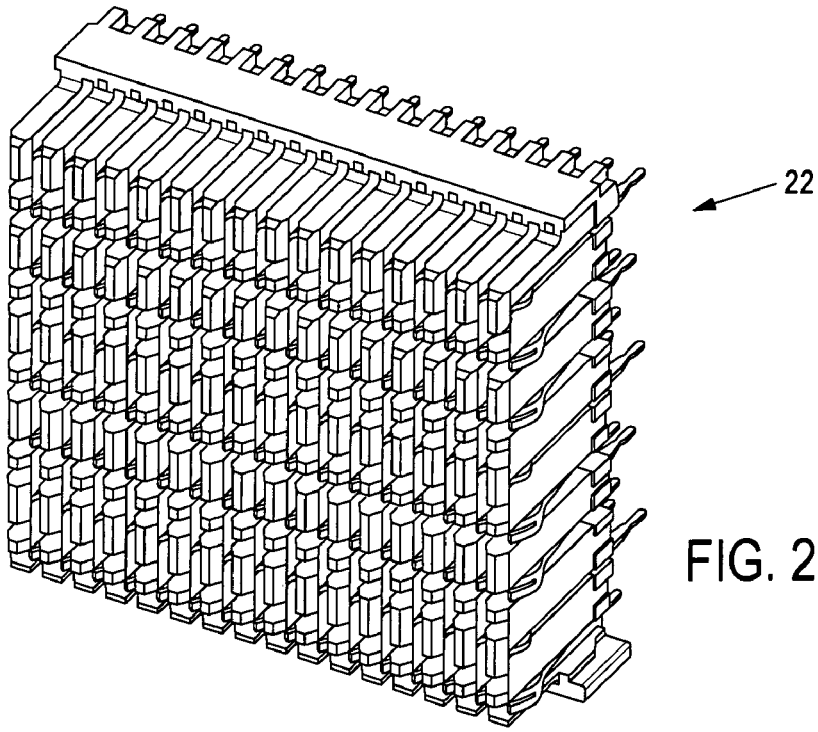
FIG. 2 is an illustration of a mating interface which engages the connector of FIG. 1.
Figure 3:
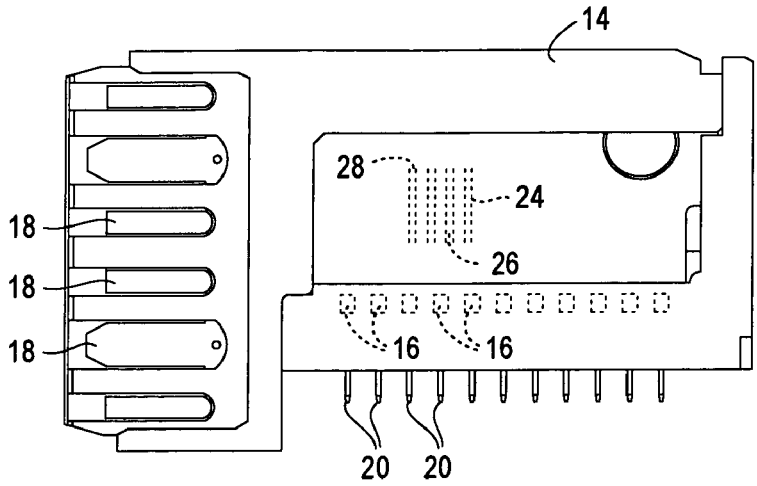
FIG. 3 is an elevational view of a daughtercard and housing of FIG. 1.

An application of the present invention in the form of a high speed connector facilitates disclosure of these concepts. FIGS. 1–3 illustrate a high density multipiece interconnect 10. FIGS. 5–8 illustrate a second connector embodiment of the present invention. One such device is a MULTIGIG RT1 connector system offered by Tyco Electronics. The connector 10 has a plurality of daughtercards 12 of a printed circuit board (PCB) wafer design housed within housing 14. Each daughtercard 12 includes a plurality of contact surfaces 16, 18. Conductive pins 20 are electrically coupled to some of contact surfaces 16 of an associated daughtercard. Contact surfaces 18 are engaged by a mating interface 22. Applications for such a connector 10 include backplanes for high end servers, telco switches and networking equipment. Connector 10 may be utilized in a systems requiring a robust connector for single ended or differential pair signals.

Figure 4:
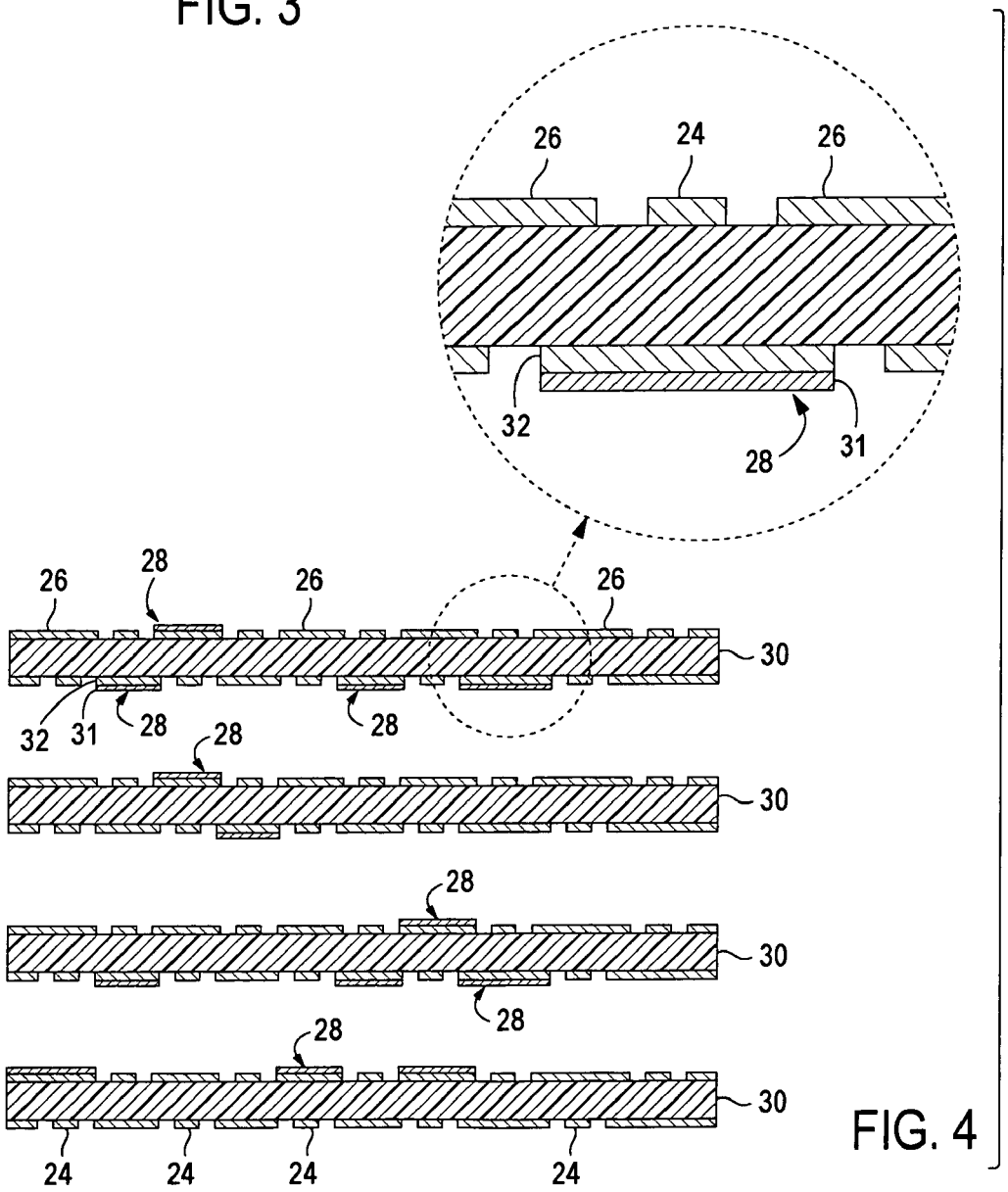
FIG. 4 is a cross sectional view of a plurality of daughtercards, such as utilized in the embodiment of FIG. 1.
Figure 5:
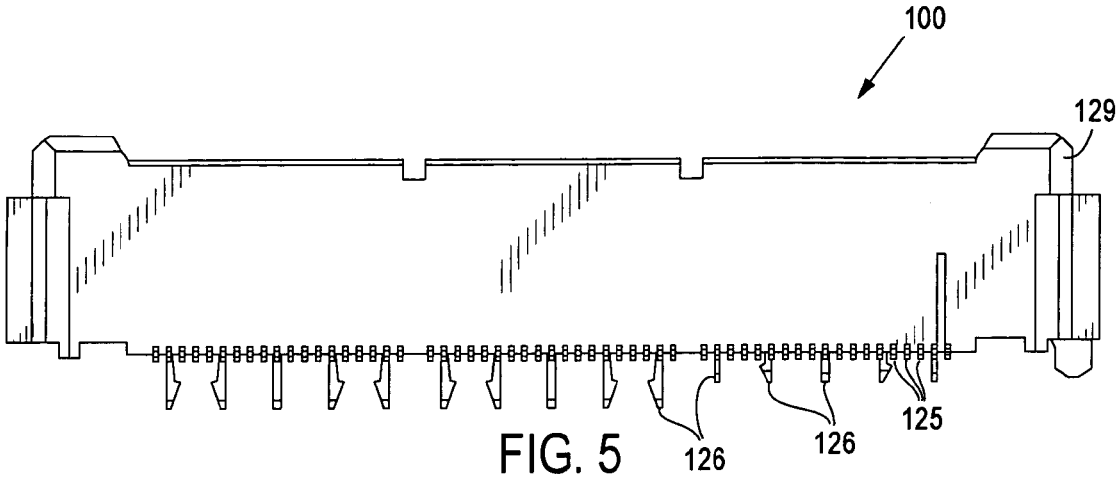
FIG. 5 is a elevational view of a second embodiment connector of the present invention.
Figure 6:
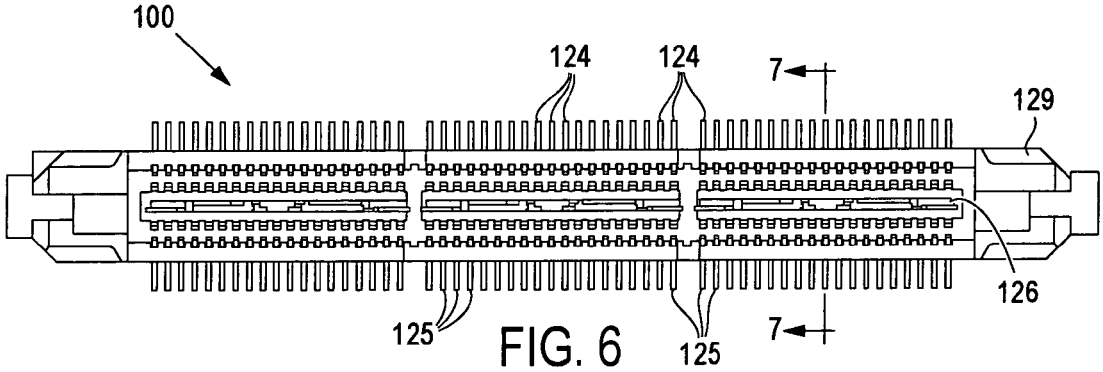
FIG. 6 is a top view of the connector of FIG. 5.

Daughtercards 12 include a plurality of conductive traces disposed on surfaces of the daughtercard. The conductive traces include signal lines 24 and ground or signal return traces 26, 28. FIG. 4 illustrates a cross sectional view of a plurality of daughtercards 12 implemented according to the present invention. Daughtercards 12 are of a PCB wafer 20 design and include a plurality of signal lines 24 and a plurality of ground traces or signal return lines 26, 28. PCB wafer 20 is a generally planar dielectric substrate. Signal lines 24 and ground traces or signal return lines 26, 28 are provided upon surfaces of PCB wafer 20 using know PCB manufacturing techniques, the details of which are not relevant to the present invention but would be appreciated by of one of ordinary skill in the arts. Ground traces 26 are comprised of a single conductive layer, while ground traces 28 include two different conductive layers 31, 32.

Materials which may be particularly suitable for the top layer 31 are those materials which have a high conductivity and/or a low permeability relative to the base layer 32, such as but not limited to silver, copper, gold, aluminum or tin. Additionally, materials which may be particularly suitable for establishing base layer 32 are those materials which have a low conductivity and/or high permeability relative to the top layer 31, such that $R_{32}>>R_{31}$. Suitable base layer 32 materials include, but are not limited to, iron, nickel, or alloys containing iron and/or nickel. Such materials permit current density to be increased in a highly conductive top layer 31 by increasing the surface resistance of the conductive base layer 32.

In accordance with the teachings herein, the conductive base layer 32 and the conductive top layer 31 of the composite ground conductor 28 are selected from those materials which establish a condition wherein $R_{32}>>R_{31}$. In this case, the attenuation of the propagating signal through the composite conductor will be substantially independent of the frequency of the signal. More particularly, by combining the expression for skin depth δ with the relationship for the surface resistance $R_{32}$, it can be seen that $R_{31}$ may be directly stated in terms of material properties as provided in the following expression:

$$R_S = \sqrt{\pi f}\sqrt{\frac{\mu}{\sigma}}$$

accordingly, the relationship $R_{32}>>R_{31}$ can be directly restated in terms of the material properties of the conductive base layer and the conductive top layer as provided in the following expression:

$$\frac{\mu_{32}}{\sigma_{32}} >> \frac{\mu_{31}}{\sigma_{31}}$$

Composite ground trace or signal return 28 made in accordance with the teachings of the present invention will incorporate a conductive base layer 32 which has a lower conductivity and/or a higher permeability with respect to the conductive top layer 31 such that $R_{32}>>R_{31}$.

Materials which may be particularly suitable for the top layer 31 are those materials which have a high conductivity and/or a low permeability relative to the base layer 32, such as but not limited to silver, copper, gold, aluminum or tin. Additionally, materials which may be particularly suitable for establishing base layer 32 are those materials which have a low conductivity and/or high permeability relative to the top layer 31, such that $R_{32}>>R_{31}$. Suitable base layer 32 materials include, but are not limited to, iron, nickel, or alloys containing iron and/or nickel. Such materials permit current density to be increased in a highly conductive top layer 31 by increasing the surface resistance of the conductive base layer 32.

The ground trace or signal return 28 according to the present invention provides for high frequency signal transmission which permits the tailoring of the attenuation and phase response of the ground trace or signal return as a function of frequency. By varying the thickness of the conductive top layer 31 and the material properties of both the conductive base 32 and conductive top layers 32, the response of signal phase and attenuation with respect to frequency may be adjusted. In this regard, the larger $R_{32}$ is with respect to $R_{31}$, the more linear the signal attenuation and signal phase become as a function of the frequency of the signal. For a connector 10 made in accordance with the teachings of the present invention, where the thickness of the conductive top layer 31 is significantly less than the skin depth of the conductive top layer 31, at all frequencies within a predetermined frequency range, it will be appreciated that the attenuation of the ground trace or signal return 28 will be substantially independent of frequency within said frequency range. As one skilled in the art would also appreciate, as the conductive top layer 31 thickness is made significantly greater with respect to skin depth, at all frequencies within a predetermined frequency range, the attenuation will become substantially equal to that of a solid conductor. By varying the top layer thickness 31 over a range of values, preferably at least twice the skin depth, a variety of desirable frequency responses may be obtained. One effect on signal transmission would be that a signal comprised of multiple frequency components being transmitted with a signal line 24 of the present invention would show significantly less phase distortion than a signal being transmitted on a prior art transmission lines.

The present invention is directed to connector 10 having a multiple conductor ground trace or signal return 28 with a conductive base layer 32 and a conductive top layer 31 wherein the conductive base layer 32 has a lower conductivity and/or a higher permeability with respect to the conductive top layer 31 such that $R_{32}>>R_{31}$.

Such a multiple conductor ground trace or signal return 28 may be defined within a range of connector configurations. The conductive top layer 31 may be disposed upon the conductive base layer 32 by methods which are generally known, such as but not limiting to electroplating, electroless plating, or vacuum vapor deposition, for example. Alternative embodiments may have layers 31, 32 defined by foil elements. Without intending to limit the scope of the present invention, the Figures illustrate a configuration of a connector made in accordance with the teachings of the present invention.

Figure 7:
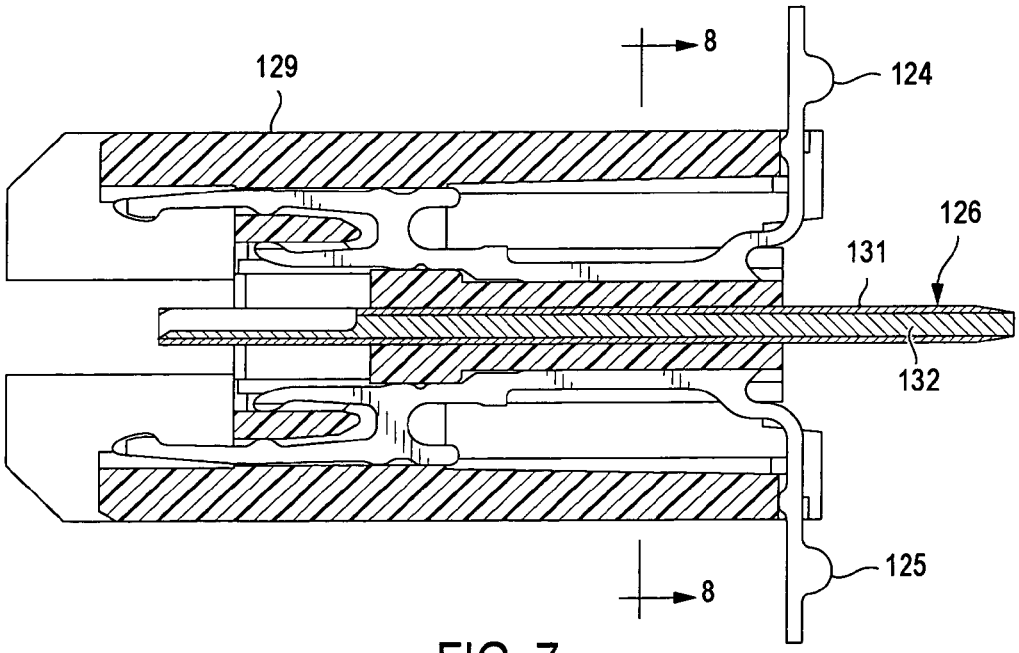
FIG. 7 is a cross sectional view of the connector of FIG. 5 taken along lines 7—7.
Figure 8:
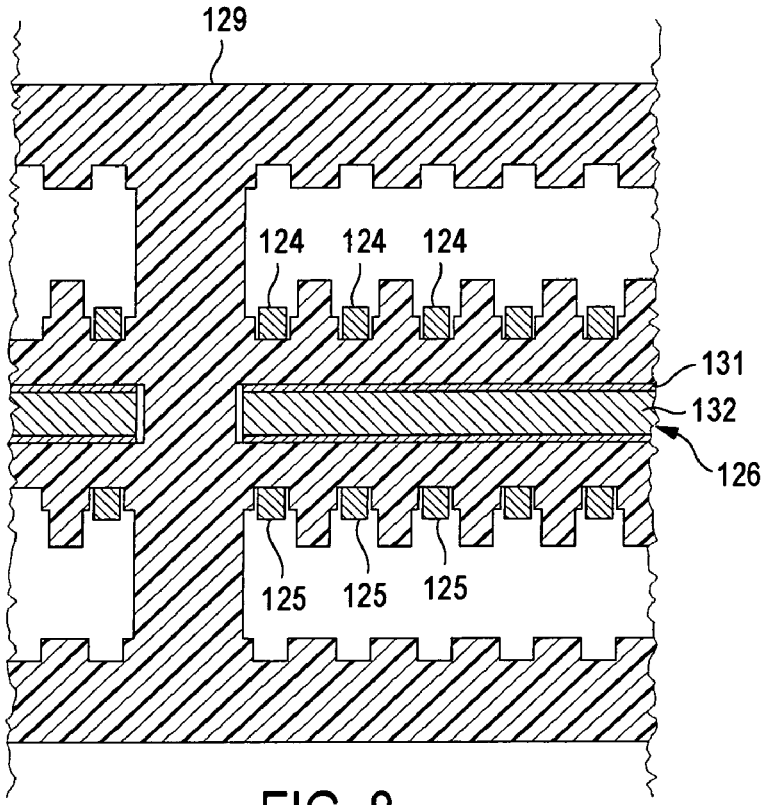
FIG. 8 is a cross sectional view of the connector of FIG. 7 taken along lines 8—8.

Now referring to FIGS. 5–8, a second embodiment of the present invention is presented herein. Connector 100 includes a plurality of signal conductors 124, 125 and a central ground bus 126 housed within polymer housing 129. FIG. 7 illustrates a cross sectional view of connector 100 wherein signal conductors 124, 125 are maintained a predetermined distance away from ground bus 126. Ground bus 126 is includes two different conductive layers 131, 132.

Materials which may be particularly suitable for the top layer 131 are those materials which have a high conductivity and/or a low permeability relative to the base layer 132, such as but not limited to silver, copper, gold, aluminum or tin. Additionally, materials which may be particularly suitable for establishing base layer 132 are those materials which have a low conductivity and/or high permeability relative to the top layer 131, such that $R_{132}>>R_{131}$. Suitable base layer 132 materials include, but are not limited to, iron, nickel, or alloys containing iron and/or nickel. Such materials permit current density to be increased in a highly conductive top layer 131 by increasing the surface resistance of the conductive base layer 132.

In accordance with the teachings herein, the conductive base layer 132 and the conductive top layer 131 of the composite ground bus 126 are selected from those materials which establish a condition wherein $R_{132}>>R_{131}$. In this case, the attenuation of the propagating signal through the composite conductor will be substantially independent of the frequency of the signal. More particularly, by combining the expression for skin depth δ with the relationship for the surface resistance $R_{132}$, it can be seen that $R_{131}$ may be directly stated in terms of material properties as provided in the following expression:

$$R_S = \sqrt{\pi f}\sqrt{\frac{\mu}{\sigma}}$$

accordingly, the relationship $R_{132} >> R_{131}$ can be directly restated in terms of the material properties of the conductive base layer and the conductive top layer as provided in the following expression:

$$\frac{\mu_{132}}{\sigma_{132}} >> \frac{\mu_{131}}{\sigma_{131}}$$

Composite ground trace or signal return 126 made in accordance with the teachings of the present invention will incorporate a conductive base layer 132 which has a lower conductivity and/or a higher permeability with respect to the conductive top layer 131 such that $R_{132} >> R_{31}$.

Materials which may be particularly suitable for the top layer 131 are those materials which have a high conductivity and/or a low permeability relative to the base layer 132, such as but not limited to silver, copper, gold, aluminum or tin. Additionally, materials which may be particularly suitable for establishing base layer 132 are those materials which have a low conductivity and/or high permeability relative to the top layer 131, such that $R_{132} >> R1_{31}$. Suitable base layer 132 materials include, but are not limited to, iron, nickel, or alloys containing iron and/or nickel. Such materials permit current density to be increased in a highly conductive top layer 131 by increasing the surface resistance of the conductive base layer 132.

The ground bus 126 provides for high frequency signal transmission which permits the tailoring of the attenuation and phase response of the ground trace or signal return as a function of frequency. By varying the thickness of the conductive top layer 131 and the material properties of both the conductive base layer 132 and conductive top layers 131, the response of signal phase and attenuation with respect to frequency may be adjusted. In this regard, the larger $R_{132}$ is with respect to $R_{131}$, the more linear the signal attenuation and signal phase become as a function of the frequency of the signal. For a connector 100 made in accordance with the teachings of the present invention, where the thickness of the conductive top layer 131 is significantly less than the skin depth of the conductive top layer 131, at all frequencies within a predetermined frequency range, it will be appreciated that the attenuation of the ground bus 126 will be substantially independent of frequency within said frequency range. As one skilled in the art would also appreciate, as the conductive top layer 131 thickness is made significantly greater with respect to skin depth, at all frequencies within a predetermined frequency range, the attenuation will become substantially equal to that of a solid conductor. By varying the top layer thickness 131 over a range of values, preferably at least twice the skin depth, a variety of desirable frequency responses may be obtained. One effect on signal transmission would be that a signal comprised of multiple frequency components being transmitted by signal conductors 124, 125 of connector 100 would show significantly less phase distortion than a signal being transmitted on a prior art transmission lines.

The conductive top layer 131 may be disposed upon the conductive base layer 132 by methods which are generally known, such as but not limiting to electroplating, electroless plating, or vacuum vapor deposition, for example. Alternative embodiments may have layers defined by foil elements. Without intending to limit the scope of the present invention, the Figures illustrate a configuration of a connector made in accordance with the teachings of the present invention.

Figure 9:
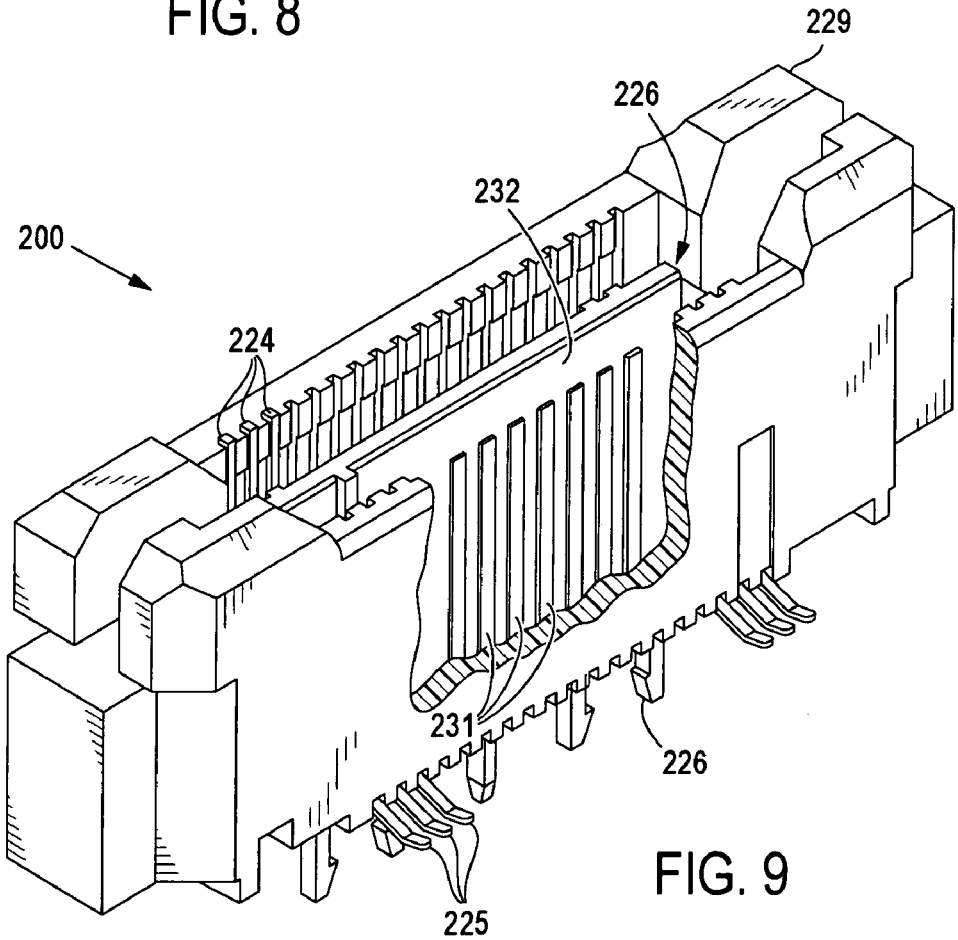
FIG. 9 is a perspective view of connector according to another embodiment of the invention.
Figure 10:
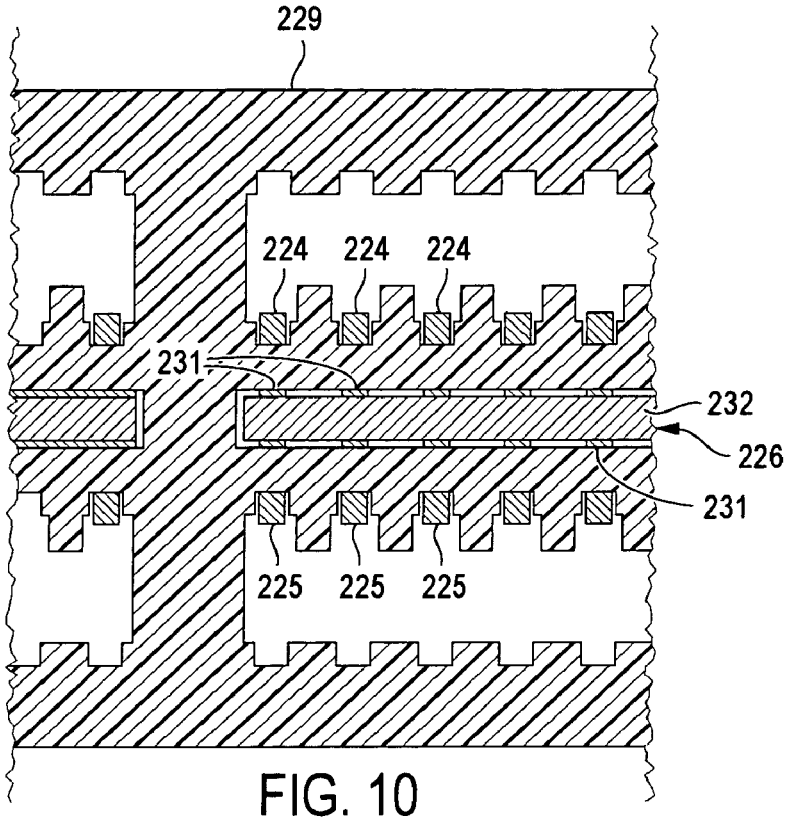
FIG. 10 is a cross sectional view of the connector of FIG. 9.
Figure 11:
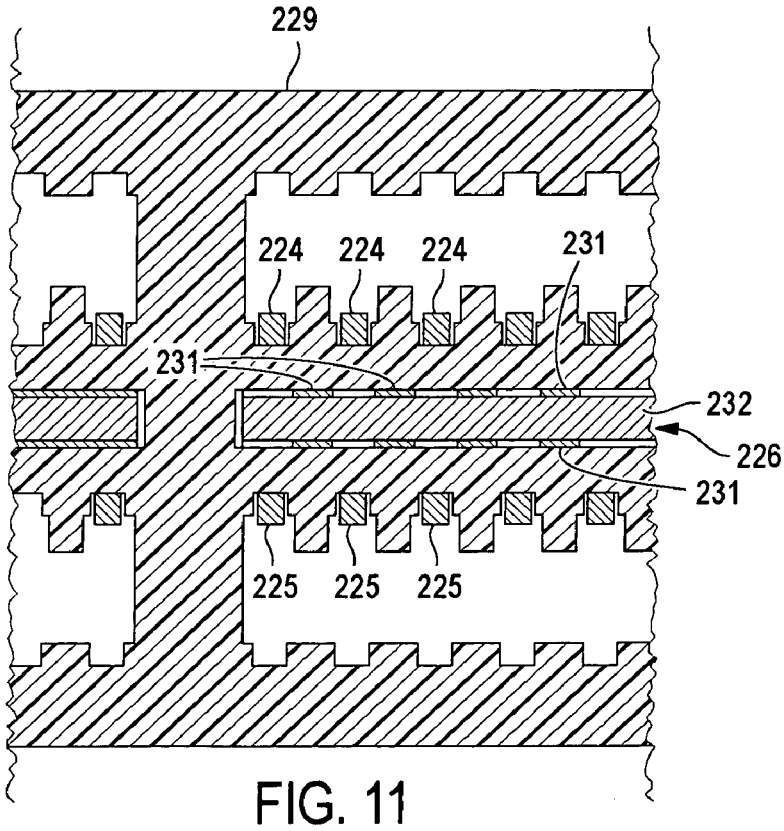
FIG. 11 is a cross sectional view of another embodiment of the present invention.

Now referring to FIGS. 9 through 11, other embodiments of the present invention are presented herein. Connector 200 includes a plurality of signal conductors 224, 225 and a central ground bus 226 housed within polymer housing 229. FIG. 10 illustrates a cross sectional view of connector 200 wherein signal conductors 224, 225 are maintained a predetermined distance away from ground bus 226. Ground bus 226 includes two different conductive layers 231, 232. As shown in FIGS. 9 through 11, conductive layers 231 are generally elongated strips which are parallel to signal conductors 224, 225. In FIG. 10, each of the conductive layers 231 is aligned directly between an associated pair of signal conductors 224, 225. In comparison, FIG. 11 illustrates another embodiment of the invention wherein the conductive layers 231 are offset from a plane containing adjacent signal conductor pairs 224, 225. A combination of aligned and offset conductive layers 231 (not shown) may also be practicable.

In accordance with the teachings herein, the conductive base layer 232 and the conductive top layer 231 of the composite ground bus 126 are selected from those materials which establish a condition wherein $R_{232} >> R_{231}$. Composite ground trace or signal return 226 made in accordance with the teachings of the present invention will incorporate a conductive base layer 232 which has a lower conductivity and/or a higher permeability with respect to the conductive top layer 231 such that $R_{232} >> R_{231}$.

Materials which may be particularly suitable for the top layer 231 are those materials which have a high conductivity and/or a low permeability relative to the base layer 232, such as but not limited to silver, copper, gold, aluminum or tin. Additionally, materials which may be particularly suitable for establishing base layer 232 are those materials which have a low conductivity and/or high permeability relative to the top layer 231, such that $R_{232} >> R_{231}$. Suitable base layer 232 materials include, but are not limited to, iron, nickel, or alloys containing iron and/or nickel. Such materials permit current density to be increased in a highly conductive top layer 231 by increasing the surface resistance of the conductive base layer 232.

The ground bus 226 provides for high frequency signal transmission with minimized cross talk between signal contacts 224, 225. By varying the thickness of the conductive top layer 231 and the material properties of both the conductive base 232 and conductive top layer 231, the return current flows within ground bus 226 are substantially contained to portions of the common ground that are closely coupled to the signal contacts 224, 225. By limiting the return current flows within top layer 231, the connector 200 has improved cross talk reduction. Importantly, current flows generally orthogonal to the signal conductors 224, 225 are minimized by providing conductive top layer 231.

For a connector 200 made in accordance with the teachings of the present invention, where the thickness of the conductive top layer 231 is significantly less than the skin depth of the conductive top layer 231, at all frequencies within a predetermined frequency range, it will be appreciated that the attenuation of the ground bus 226 will be substantially independent of frequency within said frequency range. As one skilled in the art would also appreciate, as the conductive top layer 231 thickness is made significantly greater with respect to skin depth, at all frequencies within a predetermined frequency range, the attenuation will become substantially equal to that of a solid conductor.

Although a few exemplary embodiments of the present invention have been described in detail herein, those skilled in the art readily appreciate that many modifications are possible without materially departing from the novel teachings and advantages which are described herein. Accordingly, all such modifications are intended to be included within the scope of the present invention, as defined by the following claims.

We claim:

1. A high speed signal connector comprising:

a generally planar dielectric substrate having a pair of generally opposed major surfaces;

a signal trace disposed upon one of the pair of major surfaces;

a ground trace disposed upon the other of the pair of major surfaces generally opposite the signal trace, said ground trace including a plurality of coextensive layers of different conductive materials including at least a first conductive base layer having a predetermined conductivity and permeability and a second conductive top layer having a different predetermined conductivity and permeability.

2. The high speed signal connector of claim 1, wherein the first conductive base layer has a higher surface resistance than the second conductive top layer so that a current distribution of the ground trace is redistributed from the first conductive base layer to the second conductive top layer.

3. The high speed signal connector of claim 1, wherein the second conductive top layer has a thickness of at least twice a skin depth at a transmission frequency.

4. The high speed signal connector of claim 1, wherein the dielectric substrate is a PCB wafer.

5. The high speed signal connector of claim 4, wherein the base layer and the top layer of the ground trace are provided as plating upon the PCB wafer.

6. The high speed signal connector of claim 4, wherein the base layer and the top layer of the ground trace are provided as foil elements secured to the PCB wafer.

7. A high speed signal connector comprising:

a housing;

a plurality of generally planar dielectric substrates within the housing and each having a first major surface and an opposite second major surface;

a plurality of signal traces disposed upon the first major surfaces of the dielectric substrates;

a plurality of ground traces disposed upon the second major surfaces, each of the plurality of ground traces being generally opposite a signal trace, each of the plurality of ground traces including a plurality of coextensive layers of different conductive materials including at least a first conductive base layer having a predetermined conductivity and permeability and a second conductive top layer having a different predetermined conductivity and permeability.

8. The high speed signal connector of claim 7, wherein the second conductive top layers have a thickness of at least twice a skin depth at a transmission frequency.

9. The high speed signal connector of claim 7, wherein each of the dielectric substrates is a PCB wafer.

10. The high speed signal connector of claim 9, wherein the base layers and the top layers of the ground traces are provided as platings upon the PCB wafers.

11. The high speed signal connector of claim 9, wherein the base layers and the top layers of the ground traces are provided as foil elements secured to the PCB wafers.

12. A high speed signal connector comprising:

a generally planar dielectric substrate having a pair of generally opposed major surfaces;

a plurality of signal traces disposed upon one of the pair of major surfaces;

a plurality of different ground traces disposed upon the other of the pair of major surfaces generally opposite the signal traces, wherein some of the ground traces have a single layer of conductive material and others of the ground traces have a plurality of coextensive layers of different conductive materials including at least a first conductive base layer having a predetermined conductivity and permeability and a second conductive top layer having a different predetermined conductivity and permeability.

13. A high speed signal connector comprising:

a housing;

a plurality of signal conductors within the housing;

a ground bus disposed within the housing, said ground bus including a plurality of coextensive layers of different conductive materials including at least a first conductive base layer having a predetermined conductivity and permeability and a second conductive top layer having a different predetermined conductivity and permeability.

14. The high speed signal connector of claim 13, wherein the first conductive base layer has a higher surface resistance than the second conductive top layer so that a current distribution of the ground bus is redistributed from the first conductive base layer to the second conductive top layer.

15. The high speed signal connector of claim 13, wherein the second conductive top layer has a thickness of at least twice a skin depth at a transmission frequency.

16. The high speed signal connector of claim 13, wherein the housing is a dielectric polymer.

17. The high speed signal connector of claim 13 wherein the ground bus is centrally located among the plurality of signal conductors.

18. A high speed signal connector comprising:

a housing;

a plurality of signal conductors disposed within the housing and arranged as opposed pairs;

a ground bus disposed within the housing between respective opposite signal conductors of the opposed pairs, the ground bus including a plurality of coextensive layers of different conductive materials including at least a first conductive base layer having a predetermined conductivity and permeability and a second conductive top layer having a different predetermined conductivity and permeability.

19. The high speed signal connector of claim 18, wherein the second conductive top layers have a thickness of at least twice a skin depth at a transmission frequency.

20. The high speed signal connector of claim 18, wherein the top layer of the ground bus is a plating upon the base layer.

21. The high speed signal connector of claim 18 wherein the top layer is formed as elongated strips.

22. The high speed signal conductor of claim 21 wherein the elongated strips are aligned between the signal conductors in each of the opposed pairs.

23. The high speed signal conductor of claim 21 wherein the elongated strips are offset from respective planes containing the signal conductors in each of the opposed pairs.

* * * * *